United States Patent [19]

Motoyoshi et al.

[11] 4,050,930

[45] Sept. 27, 1977

[54] ELECTRICAL CONTACT MATERIAL

[75] Inventors: Kenya Motoyoshi; Masahiro Kume; Yoshinari Amano, all of Itami, Japan

[73] Assignee: Sumitomo Electric Industries, Ltd., Osaka, Japan

[21] Appl. No.: 667,373

[22] Filed: Mar. 16, 1976

[30] Foreign Application Priority Data

June 24, 1975 Japan ..... 50-78785

[51] Int. Cl.[2] ..... C22C 5/06

[52] U.S. Cl. ..... 75/173 A; 200/266

[58] Field of Search ..... 75/173 A; 200/266

[56] References Cited

U.S. PATENT DOCUMENTS

| | | | |
|---|---|---|---|
| 3,785,810 | 1/1974 | Dürrwächter et al. | 75/173 A |
| 3,874,941 | 4/1975 | Shibata | 75/173 A |
| 3,933,485 | 1/1976 | Shibata | 75/173 A |

*Primary Examiner*—Arthur J. Steiner

*Attorney, Agent, or Firm*—Wenderoth, Lind & Ponack

[57] ABSTRACT

A material for an electrical contact is produced by an internal oxidation of an alloy consisting of 1–15% by weight of indium, 0.5–12% by weight of tin, 0.01–5% by weight of one selected from manganese and molybdenum, and the balance silver. In a modification an iron group element may be mixed in a range less than 0.5% by weight.

3 Claims, No Drawings

ELECTRICAL CONTACT MATERIAL

The present invention relates to a silver-metal oxide type material for an electrical contact produced by the internal oxidation process.

BACKGROUND OF THE INVENTION

In this kind of silver-metal oxide type contact material produced by the internal oxidation process, the silver-cadmium oxide type material has been in wide use. Since the silver-cadmium oxide contact has relatively balancing properties of low contacting resistance it is used in relays, no-fuse breakers, breakers in the air and the like which operate in a wide currant range, from air and the like applicable to the current ranging from small to large. However, the use of cadmium composing the contact material is hazardous to workers' health during the production process. Instead, silver-tungsten, silver-tungsten carbide, silver-nickel and silver-graphite are used as a cadmium-free contact material, but the silver-tungsten and silver-tungsten carbide contacts are inferior to the silver-cadmium oxide due to the rise of temperature at the contacting point caused mainly by the increase of contacting resistance upon many time opening and closing operations in the air, and the silver-nickel and silver-graphite contacts are also inferior to the silver-cadmium oxide because of the welding resistance and arc erosion resistance when used in a range from medium to large current. Accordingly, as a contact of a switching unit in contact with the air, the actual usage ranges and operable conditions for these contact materials are considerably limited. Therefore, if an excellent contact material could be obtained without using cadmium, the advantages would be great.

As is known, this requirement is partly met by the silver-indium oxide-tin oxide contact material, but this material is, however, inferior to the silver-cadmium oxide type material in the welding and arc erosion resistances when used in a range from medium to large current.

SUMMARY OF THE INVENTION

A primary object of the invention is to provide a silver-indium oxide-tin oxide type contact material which may be used in the range from medium to large current as well.

In order to achieve the object, as a result of studies on various kinds of elements to be added to an alloy, it has been found that the addition of manganese oxide or molybdenum oxide to said material can achieve a material with high welding resistance as well as arc erosion resistance equivalent or superior to the silver-cadmium oxide material.

As is well known to the art, the internal oxidation method has an advantage in that the oxides can be finely and uniformly dispersed in a metal matrix to reinforce the latter and improve the heat resistance thereof. Therefore, that method is mainly employed for the production of the prior art silver-cadmium oxide contact material, and is also adopted for the production of silver-indium oxide-tin oxide-manganese oxide or silver-indium oxide-tin oxide-molybdenum oxide material of the invention, which will now be described hereinafter in further detail. internal

DETAILED DESCRIPTION OF THE INVENTION

According to the invention, metal indium, metal tin, and metal manganese or metal molybdenum, which are less harmful than cadmium, are dissolved in silver into an alloy of silver-indium-tin-manganese or silver-indium-tin-molybdenum, which is thereafter treated by the internal oxidation. The material obtained exhibits a stable contacting resistance even after a many openings and closings and has a current carrying capacity substantially equivalent to the prior art silver-cadmium oxide contact, which will be apparent from the Examples mentioned after.

The most remarkable effect obtained by the addition of manganese or molybdenum to silver-indium oxide-tin oxide is that the particles of oxides formed by the internal oxidation are formed into spherical shape, dispersing finely and uniformly in the matrix and thereby improving the welding resistance as well as arc erosion resistance.

As for the effect of each element added to the alloy, manganese, even in a large amount, can be treated by the internal oxidation into fine and uniform dispersion of its oxide, which is heat-stabilized. Molybdenum serves to form the oxides into spherical shape and also to increase the possible oxidation concentration in the three elements of silver, tin oxide and indium oxide. Further molybdenum, even in a large amount, educes and disperses as a metal molybdenum in the silver matrix, thereby forming a mixed structure consisting of relatively coarse particles of metal molybdenum and fine particles of its oxide, without obstructing the oxidation thereof.

The ordinary amount of indium to be dissolved in silver before internal oxidation is 1 to 15% by weight. When less than 1%, is used it may be used under a relatively light load, but for the use under medium to heavy load, more than 1% of indium is preferable in order to increase the welding resistance and arc erosion resistance. More than 15% of indium is not practical since the alloy cannot then be treated with the internal oxidation.

The effective amount of tin used is in the range from 0.5 to 12% by weight, preferably 3 to 12% by weight. Less than 0.5% tin has little effect while more than 12% tin causes unstable internal oxidation.

The effective amount of manganese to be contained in the thus composed silver-indium-tin alloy is in the range from 0.01 to 5% by weight for the remarkable improvement of the properties as a contact. When more than 5% manganese is provided unstable rolling and internal oxidation results when too small an amount of manganese is added, little improvement results in the properties of the contact. Therefore it is necessary to add more than at least 0.01% by weight of manganese.

The effective amount of molybdenum ranges from 0.01 to 5% by weight. An addition of too much molybdenum causes difficulty in uniformly dispersing the molybdenum particle and is not industrially applicable. With less than 0.01% molybdenum, the particles of the oxides do not finely disperse and have little effect on promoting the properties of the contact.

Further, by the addition of iron group elements the arc erosion resistance can be improved; the effective amount thereof being less than 0.5% by weight.

In order to more clearly illustrate the invention, reference is now to be made to the following Examples, which are only for description rather than limitation to the invention. Throughout the Examples, percentages are the percentages by weight, unless otherwise specified.

EXAMPLE 1 a. 10% of indium, 4% of tin, 0.3% of manganese and the balance silver b. 5% of indium, 5% of tin, 2% of manganese and the balance silver c. 10% of indium, 6% of tin, 0.05% of molybdenum and the balance silver d. 10% of indium, 6% of tin, 3% of molybdenum and the balance silver e. 1.5% of indium, 4% of tin, 2% of manganese and the balance silver f. 1.5% of indium, 4% of tin, 2% of molybdenum and the balance silver.

Each of the above mixes (a) through (f) was melted, cast and cut into a thickness of 1.5 mm. The cast products were treated by internal oxidation at 720° C for about 150 hours in an oxygen atmosphere and cut into specimens 5 × 6 × 1.5 mm in size. Each specimen was brazed to a copper base and subjected to a make and break test using a contact tester of ASTM type under the conditions of AC 100 V, 30 A and resistance load. After 10,000 switching operations, the voltage drop (mV) between the contacts was measured, as shown in Table I. This test assured that the contact of the invention had a current carrying capacity substantially equivalent to the prior art silver-cadmium oxide contact.

TABLE I

| Specimen | Voltage Drop* |
|---|---|
| (a) | 20 - 45 mV |
| (b) | 25 - 50 mV |
| (c) | 45 mV |
| (d) | 44 mV |
| (e) | 20 - 40 mV |
| (f) | 30 - 50 mV |

*Measured at a current passage of AC 30 A.

EXAMPLE 2 a. 6% of indium, 1% of tin, 2% of manganese, 0.01% of iron and the balance silver b. 4% of indium, 2% of tin, 2% of manganese, 0.01% of iron and the balance silver.

Each of the above mixes was melted, cast and cut into a thickness of 1.5 mm. These cast products were treated by internal oxidation at 720° C for about 130 hours in an oxygen atmosphere, and cut into a specimens of 5 × 6 × 1.5 mm in size. Each specimen was brazed to a copper base. By the same process and under the same conditions as Example 1, the make and break test was conducted and the voltage drop was measured. The result is shown in Table II.

TABLE II

| Specimen | Voltage Drop |
|---|---|
| (a) | 25 - 40 mV |
| (b) | 20 - 35 mV |

EXAMPLE 3 a. 5% of indium, 5% of tin, 2% of manganese and the balance silver.

b. 2% of indium, 5% of tin, 2% of manganese and the balance silver c. 6% of indium, 1% of tin, 2% of manganese and the balance silver d. 10% of indium, 6% of tin, 0.06% of manganese and the balance silver e. 8% of indium, 8% of tin, 0.055 of molybdenum and the balance silver f. 6% of indium, 1% of tin, 2% of manganese, 0.01% of nickel and the balance silver g. 5% of indium, 5% of tin, 2% of manganese, 0.1% of iron and the balance silver h. 2% of indium, 5% of tin, 2% of manganese, 0.1% of nickel and the balance silver i. 6% of indium, 1% of tin, 2% of manganese, 0.1% of iron and the balance silver j. 8% of indium, 8% of tin, 0.05% of molybdenum, 0.02% of nickel and the balance silver.

Each of the above mixes (a) to (j) was melted; was cast and cold-rolled to the thickness of 2 mm; was treated by internal oxidation at 720° C for about 150 hours in an oxygen atmosphere; and was finally cut into a specimen of 10 × 10 × 2 mm in size. Each specimen was fitted to an electromagnetic contactor of 60 ampere frame and subjected to a contact property test under the conditions of a voltage of AC 220 V, current of 370 A, power factor of 0.5 and a switching frequency of 180 times per hour. For comparison, the following contacts (*k*) or (*n*) were prepared pursuing the same process as above. Further, the prior art silver-cadmium oxide contact (o) was prepared. The compositions of these are listed below.

k. 10% of indium, 0.06% of manganese and the balance silver l. 8% of indium and the balance silver m. 2% of indium, 5% of tin and the balance silver n. 8% of indium, 0.05% of molybdenum and the balance silver o. 13% of cadmium oxide and the balance silver After 10,000 switching operations, the consumption quantity and the voltage drop between the contacts were measured, the results of which are shown in Table III.

TABLE III

| Specimen | Consumption Quantity | Voltage Drop* |
|---|---|---|
| (a) | 300 mg | 120 mV |
| (b) | 280 mg | 110 mV |
| (c) | 350 mg | 125 mV |
| (d) | 310 mg | 120 mV |
| (e) | 405 mg | 105 mV |
| (f) | 300 mg | 100 mV |
| (g) | 280 mg | 120 mV |
| (h) | 260 mg | 115 mV |
| (i) | 290 mg | 112 mV |
| (j) | 380 mg | 105 mV |
| (k) | 340 mg | 115 mV |
| (l) | 580 mg | 130 mV |
| (m) | 460 mg | 120 mV |
| (n) | 425 mg | 110 mV |
| (o) | 500 mg | 105 mV |

*Measured at a current passage of AC 150 A, including the contact base.

Succeeding the above 10,000 switchings, the test was continued to 20,000 times. As a result, the silver-8% indium contact was welded after 11,200 times. On the other hand, the contacts of the invention as well as the silver-13% cadmium oxide contact of the prior art were not welded after 20,000 times.

EXAMPLE 4 a. 8% of indium, 8% of tin, 5% of molybdenum and the balance silver b. 6% of indium, 6% of tin, 2% of manganese and the balance silver c. 5% of indium, 2% of tin, 2% of manganese and the balance silver d. 6% of indium, 1% of tin, 2% of molybdenum, 0.01% of nickel and the balance silver e. 8% of indium, 1% of tin, 0.05% of molybdenum, 0.001% of iron and the balance silver Each of the above mixes (a) to (e) was melted, cast and cut in the thickness of 1.5 mm. The cast mixtures were treated by internal oxidation at 700° C for about 200 hours in an oxygen atmosphere, and thereafter cut into specimens 5 × 6 × 1.5 mm in size. Each specimen was brazed to a copper base. The welding force was measured by passing a current of 2,500 A (crest) 1.5 cycles one time under the conditions of AC 220 V (60 Hz), a contact pressure of 500 gr and a resistance load. For comparison, silver-13% cadmium oxide contact (f) was also tested. The results are shown in Table IV.

TABLE IV

| Specimen | Welding Force (gr) |
|---|---|
| (a) | 250 |
| (b) | 100 |
| (c) | 270 |
| (d) | 100 |
| (e) | 200 |
| (f) | 500 |

Further, the contact materials of the invention showed good appearance and had properties substantially equivalent to the prior art silver-cadmium oxide contact.

EXAMPLE 5 a. 6% of indium, 10% of tin, 0.1% of manganese and the balance silver b. 8% of indium, 1% of tin, 1% of manganese, 0.001% of iron and the balance silver c. 4% of indium, 2% of tin, 2% of molybdenum and the balance silver Each of the above mixes (a) to (c) was melted, cast and cut in the thickness of 2 mm. These mixtures were then treated by internal oxidation at 720° C for about 160 hours in an oxygen atmosphere, and cut in specimens 5 × 6 × 2 mm in size. Each specimen was brazed to a copper base and subjected to a circuit breaking test under the conditions of AC 220 V, 3000 A and power factor of 0.4. For comparison, the same circuit breaking test was conducted using each of the contacts (d) to (g) and the contact (h) of silver-cadmium oxide.

d. 8% of indium, 1% of tin and the balance silver e. 4% of indium, 2% of tin and the balance silver f. 6% of indium, 0.1% of manganese and the balance silver.

g. 6% of indium and the balance silver. h. 13% of cadmium oxide and the balance silver Each current breaking operation was conducted twice and the state of arc erosion was observed. The internal oxidation contacts (d) to (g), by comparison showed relatively large arc erosion as a whole, particularly the contact (g) showing the large consumption at its end portions, while the contacts (a) to (c) and (h) showed stable appearances.

As described hereinbefore in detail, the silver-indium oxide-tin oxide-manganese oxide and silver-indium oxide-tin oxide-molybdenum oxide type contact materials of the invention exhibit excellent resistances against contact consumption, against welding, and against arc erosion, as compared to the silver-indium oxide-tin oxide contact material, and further have properties equivalent to or superior to the silver-cadmium oxide contact material of the prior art. Also with respect to cost, the contact material of the invention is almost equivalent to the silver-cadmium oxide material. Therefore the industrial usage of the material of the invention is very high.

We claim:

1. An electrical contact material produced by internal oxidation of an alloy consisting of 1–15% by weight of metal indium, 0.5–12% by weight of metal tin, 0.01–5% by weight of one metal selected from the group consisting of manganese and molybdenum, and the balance silver, wherein oxides are formed by said internal oxidation which are spherical in shape and finely and uniformly dispersed.

2. An electrical contact material produced by an internal oxidation of an alloy consisting of 1–15% by weight of metal indium, 3–12% by weight of metal tin, 0.01–5% by weight of one metal selected from the group consisting of manganese and molybdenum, and the balance silver, wherein oxides are formed by said internal oxidation which are spherical in shape and finely and uniformly dispersed.

3. An electrical contact material produced by an internal oxidation of an alloy consisting of 1–15% by weight of metal indium, 0.5–12% by weight of metal tin, 0.01–5% by weight of 1 metal selected from the group consisting of manganese molybdenum, less than 0.5% by weight of iron group element, and the balance silver, wherein oxides are formed by said internal oxidation which are spherical in shape and finely and uniformly dispersed.

* * * * *